US006015960A

United States Patent [19]

Girodet et al.

[11] Patent Number: 6,015,960

[45] Date of Patent: Jan. 18, 2000

[54] COMPRESSED GAS INTERRUPTER WITH A RACK MECHANISM

[75] Inventors: Alain Girodet, Villeurbanne; Marc Vittoz, Lyon, both of France

[73] Assignee: GEC Alsthom T&D SA, Paris, France

[21] Appl. No.: 09/164,357

[22] Filed: Oct. 1, 1998

[30] Foreign Application Priority Data

Oct. 2, 1997 [FR] France ..... 97 12263

[51] Int. Cl.[7] ..... H01H 33/18; H01H 33/70; H01H 33/82

[52] U.S. Cl. ..... 218/43; 218/140; 218/154; 218/78

[58] Field of Search ..... 218/7, 12–13, 218/14, 43, 45, 48–50, 74, 78, 118, 120, 140, 143, 154, 59–67

[56] References Cited

U.S. PATENT DOCUMENTS

| | | | |
|---|---|---|---|
| 525,332 | 9/1894 | Card | 200/144 R |
| 3,665,135 | 5/1972 | Boersma et al. | 200/163 |
| 3,883,709 | 5/1975 | Cole | 200/144 B |
| 3,896,282 | 7/1975 | Chabala . | |
| 4,211,902 | 7/1980 | Tsuchida | 200/148 R |
| 5,578,806 | 11/1996 | Hofbauer et al. | 218/59 |
| 5,808,257 | 9/1998 | Thuries | 218/60 |

FOREIGN PATENT DOCUMENTS

| | | |
|---|---|---|
| 0 313 813 A1 | 5/1989 | European Pat. Off. . |
| 0 785 562 A1 | 7/1997 | European Pat. Off. . |
| 2 354 625 | 1/1978 | France . |
| 29 46 929 A1 | 5/1981 | Germany . |

*Primary Examiner*—Lincoln Donovan
*Attorney, Agent, or Firm*—Sughrue, Mion, Zinn Macpeak & Seas, PLLC

[57] ABSTRACT

A compressed gas interrupter having a first contact piece having a hollow wear contact into which, during closure, there is inserted a rod-shaped wear contact provided on a second contact piece, an insulating nozzle on the same axis as the two contact pieces and fixed to the first contact piece with the throat of the nozzle having the wear contact of the second contact piece passing therethrough on closure, the nozzle connecting a gas compression chamber to an exhaust chamber, the wear contact of the second contact piece being movable along an axis and being displaced in the opposite direction to the wear contact of the first contact piece by a rack mechanism organized to transmit movement in opposite directions from the first contact piece to the second contact piece. The rack mechanism is disposed upstream from the throat of the nozzle so as to be situated off the path of the hot gases leaving the nozzle on interruption.

7 Claims, 1 Drawing Sheet

COMPRESSED GAS INTERRUPTER WITH A RACK MECHANISM

BACKGROUND OF THE INVENTION

The invention relates to a compressed gas interrupter with a rack mechanism. Such an interrupter is already known from European patent No. 0 313 813. In that known interrupter, the pinions of the rack mechanism are placed downstream from the throat of the nozzle which channels the hot gases on interruption. Over time, this results in the mechanism becoming damaged, and the object of the invention is to remedy that drawback.

OBJECT AND SUMMARY OF THE INVENTION

To this end, the invention provides a compressed gas interrupter comprising a first contact piece having a hollow wear contact into which, during closure, there is inserted a rod-shaped wear contact provided on a second contact piece, an insulating nozzle on the same axis as the two contact pieces and fixed to the first contact piece with the throat of the nozzle having the wear contact of the second contact piece passing therethrough on closure, the nozzle connecting a gas compression chamber to an exhaust chamber, the wear contact of the second contact piece being movable along an axis and being displaced in the opposite direction to the wear contact of the first contact piece by a rack mechanism organized to transmit movement in opposite directions from the first contact piece to the second contact piece, wherein the rack mechanism is disposed upstream from the throat of the nozzle.

As a result, the rack mechanism is situated off the path of the hot gases.

BRIEF DESCRIPTION OF THE DRAWING

An embodiment of the invention is described below in greater detail and is shown in the drawing.

MORE DETAILED DESCRIPTION

In the figures, there can be seen two contact pieces 1 and 2 that are located in an envelope (not shown) filled with an insulating gas such as $SF_6$ under a pressure of a few bars, which contact pieces can be engaged one in the other and can be disengaged one from the other along a longitudinal axis 3.

Figure 2:
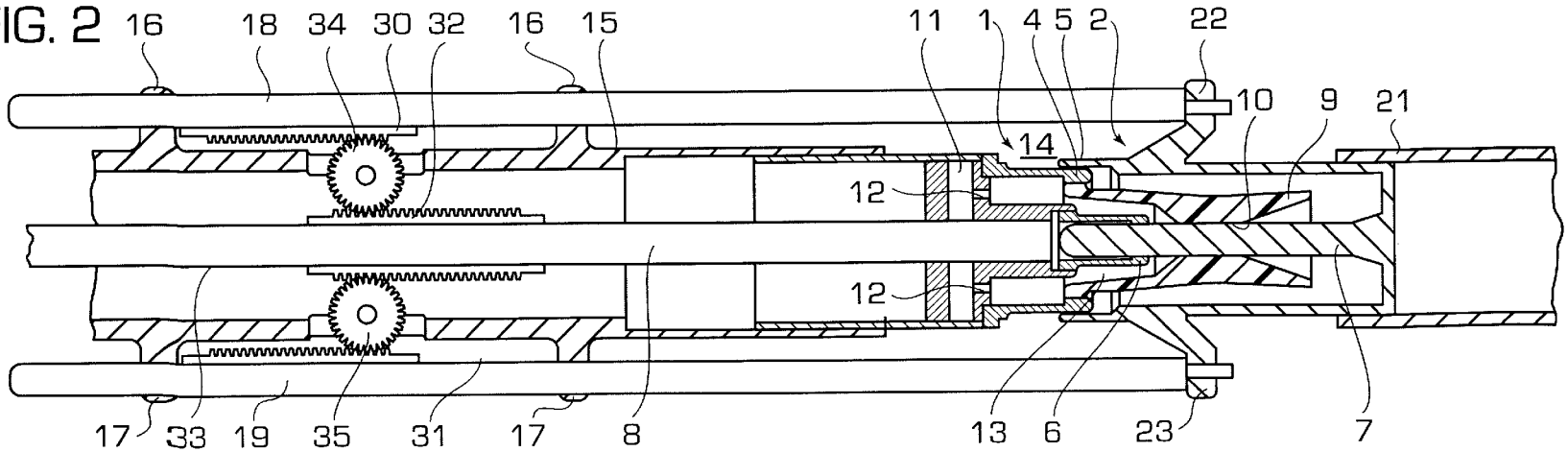
FIG. 2 shows the FIG. 1 circuit breaker in the closed position.

The two contact pieces 1 and 2 are essentially circularly symmetrical, i.e. they are essentially tubular, each comprising a respective permanent current contact 4, 5 and a respective wear contact 6, 7. The wear contact 6 is hollow while the wear contact 7 is in the form of a rod which is inserted on interruption into the hollow wear contact 6, as can be seen in FIG. 2.

The contact pieces 1 can slide along the axis 3. The contact piece 1 is displaced along the axis 3 by applying axial translation movement to a control rod 8 which extends outside the envelope. The contact piece 1 has an insulating nozzle 9 with a throat 10 disposed coaxially between the permanent current contact 4 and the wear contact 6, and rigidly connected to the permanent current contact 4 and to the wear contact 6. The contact piece 1 also has an annular compression chamber 11 where compression is provided by a piston, which chamber can be put into communication with an exhaust chamber 14 via check valves 12 formed through a ring that interconnects the permanent contact 4 and the wear contact 6, and via an annular channel 13 provided between the wear contact 6 and the inside wall of the insulating nozzle 9, and via the throat 10 of the insulating nozzle. The annular channel 13 defines a thermal compression chamber. The contact piece 1 is also surrounded by a sliding contact (not shown) and is organized to slide in a metal guide tube 15 that is mounted stationary inside the envelope and that extends along the axis 3. The tube 15 carries bearings 16 and 17 on its outside wall, with the two bearings 16 being diametrically opposite to the two bearings 17 about the axis 3, and with each pair of bearings 16 & 17 serving to guide a respective rod 18 or 19 secured to the piece 2 in translation along the axis 3.

In the contact piece 2, the permanent current contact 5 which surrounds the rod-shaped wear contact 7 and which is secured thereto is tubular in shape and is mounted to move along the axis 3 in a guide tube 21 which is mounted stationary inside the envelope and which extends along the axis 3 in line with the tube 15. Current passes between the tube 21 and the permanent current contact 5 via a sliding contact that is not shown. The permanent current contact 5 also has two protuberances 22 and 23 extending radially outside the tube 21 and diametrically opposite each other about the axis 3, which protuberances have the respective rods 18 and 19 fixed thereto.

In the embodiment of the gas interrupter of the invention, high separation speed is achieved for the contacts by using a rack mechanism, with this speed being substantially twice the displacement speed of the contact piece 1. In this case, the rack mechanism comprises two first racks 30 and 31 extending parallel to the axis 3 and fixed to the rods 18 and 19 respectively at the same end as the contact piece 1 with their teeth facing towards the tube 15. The mechanism also has two second racks 32 and 33 extending parallel to the racks 30 and 31 and fixed on the outside wall of the drive rod 8 inside the tube 5 so that their teeth face towards the tube 15. Finally, the mechanism has two pinions 34 and 35 inserted in a diametrically opposite configuration in the wall of the tube 15 about the axis 3 and each capable of rotating freely about a pin that is stationary relative to the axis 3 and secured to the tube 15 in such a manner that the teeth of the pinions 34 and 35 engage in the respective pairs of racks 30 & 32 and 31 & 33. More particularly, each pinion 34 or 35 is received in a slot formed through the thickness of the tube 15 to engage both a rack such as 32 or 33 provided on the control rod 8 and located inside the tube and a rack such as 30 or 31 provided on a rod fixed to the contact piece 2 and located outside the tube 15.

Figure 1:
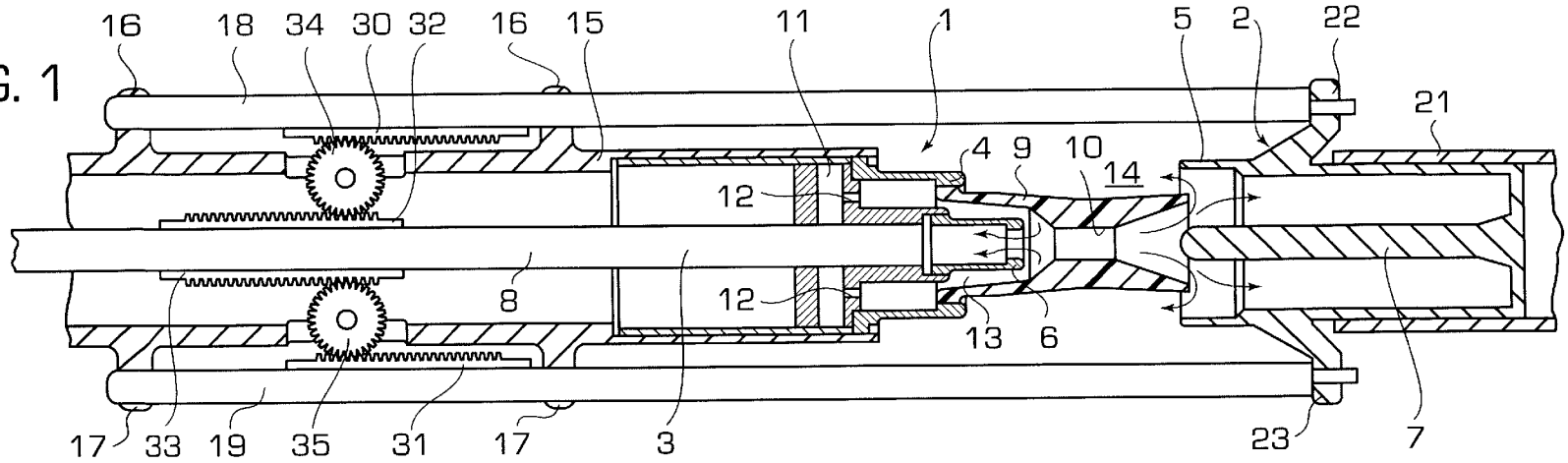
FIG. 1 is a highly diagrammatic view of a circuit breaker of the invention in an open position at the time of interruption.

As can be seen in FIG. 1, this rack and pinion mechanism is located essentially upstream from the throat 10 of the nozzle 9, i.e. away from the path of the hot gases produced on interruption and represented by thick arrows in FIG. 1.

FIG. 2 shows the circuit breaker in the closed position. Its wear contact 7 is inserted in its wear contact 6. During interruption, as shown in FIG. 1, the contact piece 1 is displaced by means of the rod 8 to the left along the axis 3, as are the racks 32 and 33. This leftwards movement is converted by the pinions 34 and 35 engaging the racks 30 and 31 into rightwards movement of the rods 18 and 19 and thus of the contact piece 2, said movement having the same speed but being in the opposite direction to the movement of the contact piece 1. When the contacts separate, the wear contacts 6 and 7 are therefore moved apart from each other at a speed that is twice the displacement speed of the control rod 8. The hot gases are channeled by the nozzle 9 so as to flow between the permanent current contacts 4 and 5 and the wear contacts 6 and 7. Since the rack and pinion mechanism is set back upstream from the throat 10 of the nozzle 9, it is not affected by the hot gases.

We claim:

1. A compressed gas interrupter for opening and closing a circuit, comprising:

a first and second contact piece, said first contact piece having a hollow wear contact, said second contact piece having a rod-shaped wear contact, wherein said rod-shaped wear contact is inserted into said hollow wear contact during closing of the circuit;

an insulating nozzle disposed on a same axis as said first and second contact pieces, said insulating nozzle having a throat and being fixed to the first contact piece while the rod-shaped wear contact passes through the throat of said insulating nozzle, wherein said insulating nozzle connects a gas compression chamber to an exhaust chamber, and wherein a rack mechanism is provided for opening the circuit by moving the rod-shaped wear contact of the second contact piece and the hollow wear contact of the first contact piece in directions opposite from one another along the axis, so that the first contact piece and the second contact piece are separated from each other, wherein the rack mechanism is disposed upstream from the throat of the insulating nozzle so that a flow of hot gasses escaping from the nozzle during opening of the circuit does not interfere with the rack mechanism.

2. The interrupter of claim 1, wherein said rack mechanism comprises at least one pinion rotatable about a stationary pin and at least two racks disposed parallel to the axis, wherein said at least one pinion is disposed between said at least two racks, one rack being secured to the first contact piece and the other rack being secured to the second contact piece, so that rotation of the pinion causes the two racks to move relatively to one another.

3. The interrupter of claim 2, in which the rack secured to the first contact piece is fixed on a drive rod slidable along the axis and secured to the first contact piece.

4. The interrupter of claim 2, in which the rack secured to the second contact piece is fixed on a rod slidable along the axis and secured to the second contact piece.

5. The interrupter according to claim 2, in which the pinion is mounted to rotate on a pin secured to a tube in which the first contact piece slides.

6. The interrupter of claim 4, in which the pinion is mounted to rotate on a pin secured to a tube in which the first contact piece slides, and in which the rod secured to the second contact piece is slidably mounted in bearings secured to the tube in which the first contact piece slides.

7. The interrupter of claim 3, in which the pinion is mounted to rotate on a pin secured to a tube in which the first contact piece slides, and in which the rod secured to the second contact piece is slidably mounted in bearings secured to the tube in which the first contact piece slides, and in which the rod secured to the first contact piece is disposed inside the tube in which the first contact piece slides, and the rod secured to the second contact piece is disposed outside said tube.

* * * * *